US009384926B2

(12) United States Patent
Kim

(10) Patent No.: US 9,384,926 B2
(45) Date of Patent: Jul. 5, 2016

(54) METHOD AND APPARATUS FOR RESTORING MECHANICAL RELAY FROM STUCK FAULT TO NORMAL CONDITION

(71) Applicant: MANDO CORPORATION, Pyeongtaek-si (KR)

(72) Inventor: Do Young Kim, Suwon-si (KR)

(73) Assignee: MANDO CORPORATION, Pyeongtaek-Si (KR)

( * ) Notice: Subject to any disclaimer, the term of this patent is extended or adjusted under 35 U.S.C. 154(b) by 146 days.

(21) Appl. No.: 14/464,537

(22) Filed: Aug. 20, 2014

(65) Prior Publication Data

US 2015/0055269 A1 Feb. 26, 2015

(30) Foreign Application Priority Data

Aug. 20, 2013 (KR) ..... 10-2013-0098351

(51) Int. Cl.

| | |
|---|---|
| ***H01H 47/12*** | (2006.01) |
| ***H01H 47/22*** | (2006.01) |
| *H01H 3/00* | (2006.01) |
| *H01H 47/00* | (2006.01) |
| *H01H 1/00* | (2006.01) |

(52) U.S. Cl.

CPC ..... *H01H 47/22* (2013.01); *H01H 1/0015* (2013.01); *H01H 3/001* (2013.01); *H01H 47/002* (2013.01); *H01H 2047/003* (2013.01)

(58) Field of Classification Search

USPC ..... 361/160, 170, 179

See application file for complete search history.

(56) References Cited

U.S. PATENT DOCUMENTS 6,137,193 A * 10/2000 Kikuoka ..... H01H 47/002 307/137

7,298,148 B2 * 11/2007 Drake ..... G01R 31/3278 324/418

FOREIGN PATENT DOCUMENTS

KR 1998-0054057 9/1998

* cited by examiner

*Primary Examiner* — Danny Nguyen

(74) *Attorney, Agent, or Firm* — Ladas & Parry, LLP

(57) ABSTRACT

Disclosed herein are a method and apparatus for restoring a mechanical relay from a stuck fault to a normal condition. The method may include detecting, by an MCU, a short state or open state of a relay, repeatedly transferring, by the MCU, a current application signal and a current non-application signal to a relay driver when the relay is in the short state, repeating, by the relay driver, an operation of periodically applying an electric current from a power source unit to the relay in response to the current application signal and the current non-application signal so that the release of the contact point of the relay is induced, detecting, by the MCU, the release state of the contact point of the relay, and maintaining, by the MCU, an ECU in an operating state when the contact point of the relay is released.

6 Claims, 4 Drawing Sheets

METHOD AND APPARATUS FOR RESTORING MECHANICAL RELAY FROM STUCK FAULT TO NORMAL CONDITION

BACKGROUND OF THE INVENTION

1. Field of the Invention

Exemplary embodiments of the present invention relate to an apparatus and method for restoring a mechanical relay used in a vehicle from a temporary stuck fault to a normal condition, and more particularly, to a method and apparatus for restoring a mechanical relay from a stuck fault to a normal condition, wherein if a temporary stuck fault attributable to impurities at the contact point of the mechanical relay or a low temperature is generated in the mechanical relay when an Electronic Control Unit (ECU) detects a failure that may affect a driver, an operation of periodically applying an electric current to the coil of the mechanical relay configured to stop a random operation of an actuator by blocking the supply of an electric current to the actuator is repeated so that heat and an electrical movement are provided, thereby being capable of restoring the mechanical relay from the temporary stuck fault to a normal condition and preventing the ECU from being detected as being a failure.

2. Description of the Related Art

In general, a vehicle is equipped with an ECU configured to receive electrical signals detected by a variety of types of input sensors and to output digital control signals for driving a variety of types of actuators on the output side.

The ECU for a vehicle uses a mechanical relay for a safety function. The mechanical relay functions to stop a random operation of an actuator by blocking an electric current supplied to the actuator when the ECU detects a failure that may affect a driver.

The mechanical relay may be subject to a temporary stuck fault attributable to the impurities of a contact point or a low temperature. An existing safety function is configured to operate after the open/short function of the mechanical relay is checked. If the mechanical relay is temporarily stuck, the ECU determines such a temporary stuck state to be a failure because the operation of the mechanical relay is unable to be guaranteed.

Accordingly, there is a problem in that the failure rate of the ECU may rise depending on a low temperature condition and the lifespan of the mechanical relay because the ECU determines a temporary stuck fault to be a failure when the temporary stuck fault is generated in the mechanical relay due to the impurities of a contact point or a low temperature.

PRIOR ART DOCUMENT

Patent Document (Patent Document 1) Korean Patent Application Publication No. 1998-054057 (Sep. 25, 1998)

SUMMARY OF THE INVENTION

An object of the present invention is to provide a method and apparatus for restoring a mechanical relay from a stuck fault to a normal condition, wherein if a temporary stuck fault attributable to impurities at the contact point of the mechanical relay or a low temperature is generated in the mechanical relay when an Electronic Control Unit (ECU) detects a failure that may affect a driver, an operation of periodically applying an electric current to the coil of the mechanical relay configured to stop a random operation of an actuator by blocking the supply of an electric current to the actuator is repeated so that heat and an electrical movement are provided, thereby being capable of restoring the mechanical relay from the temporary stuck fault to a normal condition and preventing the ECU from being detected as being a failure.

In accordance with an aspect of the present invention for achieving the object of the present invention, a method for restoring a relay from a stuck fault to a normal condition in an apparatus including a power source unit, the relay, a relay driver, an MCU, and an ECU includes the steps of detecting, by the MCU, the short state or open state of the relay, repeatedly transferring, by the MCU, a current application signal and a current non-application signal to the relay driver when the relay is in the short state, repeating, by the relay driver, an operation of periodically applying an electric current from the power source unit to the relay in response to the current application signal and the current non-application signal so that the release of a contact point of the relay is induced, detecting, by the MCU, the release state of the contact point of the relay, and maintaining, by the MCU, the ECU in an operating state when the contact point of the relay is released.

In this case, detecting the short state or open state of the relay may include detecting, by the MCU, the short state or the open state based on a voltage difference obtained by comparing voltage at the front of the relay with voltage at the rear of the relay when a power source from the power source unit is supplied to an actuator through the relay.

Furthermore, repeating the operation of periodically applying the electric current may include repeating, by the relay driver, an operation of turning on a switching element in response to the current application signal of a high level so that the electric current is applied from the power source unit to the relay or an operation of turning off the switching element in response to the current non-application signal of a low level so that an electric current is not applied from the power source unit to the relay.

In accordance with another aspect of the present invention for achieving the object of the present invention, an apparatus for restoring a mechanical relay from a stuck fault to a normal condition includes a power source unit configured to supply a power source, a relay configured to supply the power source from the power source unit to an actuator or block the supply of the power source from the power source unit to the actuator, a relay driver configured to execute the supply or blocking of the relay according to a switching operation, and an MCU configured to detect the short state or open state of the relay and to repeatedly transfer a current application signal and a current non-application signal to the relay driver when the relay is in the short state, wherein the relay driver repeats an operation of periodically applying an electric current from the power source unit to the relay in response to the current application signal and the current non-application signal so that the release of a contact point of the relay is induced, and the MCU detects the release state of the contact point of the relay and maintains an ECU in an operating state when the contact point of the relay is released.

Furthermore, the MCU may be further configured to detect the short state or open state of the relay based on a voltage difference obtained by comparing voltage at the front of the relay and voltage at the rear of the relay when a power source from the power source unit is supplied to the actuator through the relay.

Furthermore, the relay driver may be further configured to repeat an operation of turning on a switching element in response to the current application signal of a high level so that the electric current is applied from the power source unit to the relay or an operation of turning off the switching element in response to the current non-application signal of a low level so that an electric current is not applied from the power source unit to the relay.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF SPECIFIC EMBODIMENTS

Figure 1:
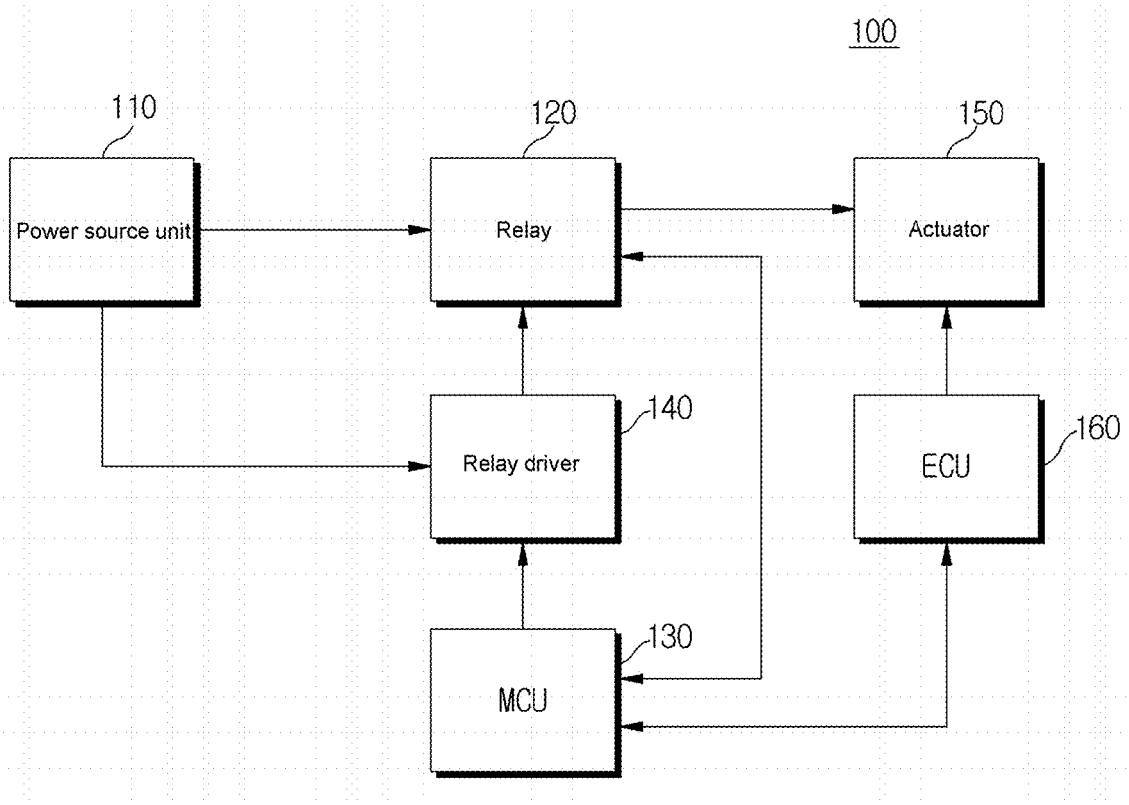
FIG. 1 is a diagram illustrating the configuration of an apparatus for restoring a mechanical relay from a stuck fault to a normal condition in accordance with an embodiment of the present invention.

The present invention may be modified in various ways and may be implemented to have several embodiments. Specific embodiments of the present invention are illustrated in the drawings and are described in detail in the detailed description. It is however to be noted that the present invention is not intended to be limited to the specific embodiments, but is intended to include all modifications, equivalents, or substitutions which fall within the spirit and technical scope of the present invention.

Embodiments of a method and apparatus for restoring a mechanical relay from a stuck fault to a normal condition according to the present invention are described in detail with reference to the accompanying drawings. In describing the embodiments with reference to the accompanying drawings, the same or corresponding elements are assigned the same reference numerals, and a redundant description thereof is omitted FIG. 1 is a diagram illustrating the configuration of an apparatus for restoring a mechanical relay from a stuck fault to a normal condition in accordance with an embodiment of the present invention.

The apparatus 100 for restoring a mechanical relay from a stuck fault to a normal condition in accordance with an embodiment of the present invention includes a power source unit 110, a relay 120, a Main Control Unit (MCU) 130, a relay driver 140, an actuator 150, and an ECU 160.

The power source unit 110 supplies a power source for the operations of the elements of a vehicle.

The relay 120 performs an operation of supplying the power source of the power source unit 110 to the actuator 150 or blocking the power source of the power source unit 110 supplied to the actuator 150.

The MCU 130 detects the short state or open state of the relay 120, and repeatedly transfers a current application signal and a current non-application signal to the relay driver 140 when detecting the relay 120 in the short state.

The relay driver 140 executes the power supply or blocking operation of the relay 120 according to a switching operation. That is, the relay driver 140 induces the release of a contact point by repeating a current application and non-application operation from the power source unit 110 to the relay 120 in response to the current application signal and the current non-application signal.

Accordingly, the MCU 130 detects the release state of the contact point of the relay 120, and maintains the ECU 160 in an operating state when detecting the release of the contact point of the relay 120.

Furthermore, when the power source from the power source unit 110 is supplied to the actuator 150 through the relay 120, the MCU 130 may detect the short state or open state of the relay 120 based on a voltage difference obtained by comparing voltage at the front of the relay 120 with voltage at the rear of the relay 120.

Figure 2:
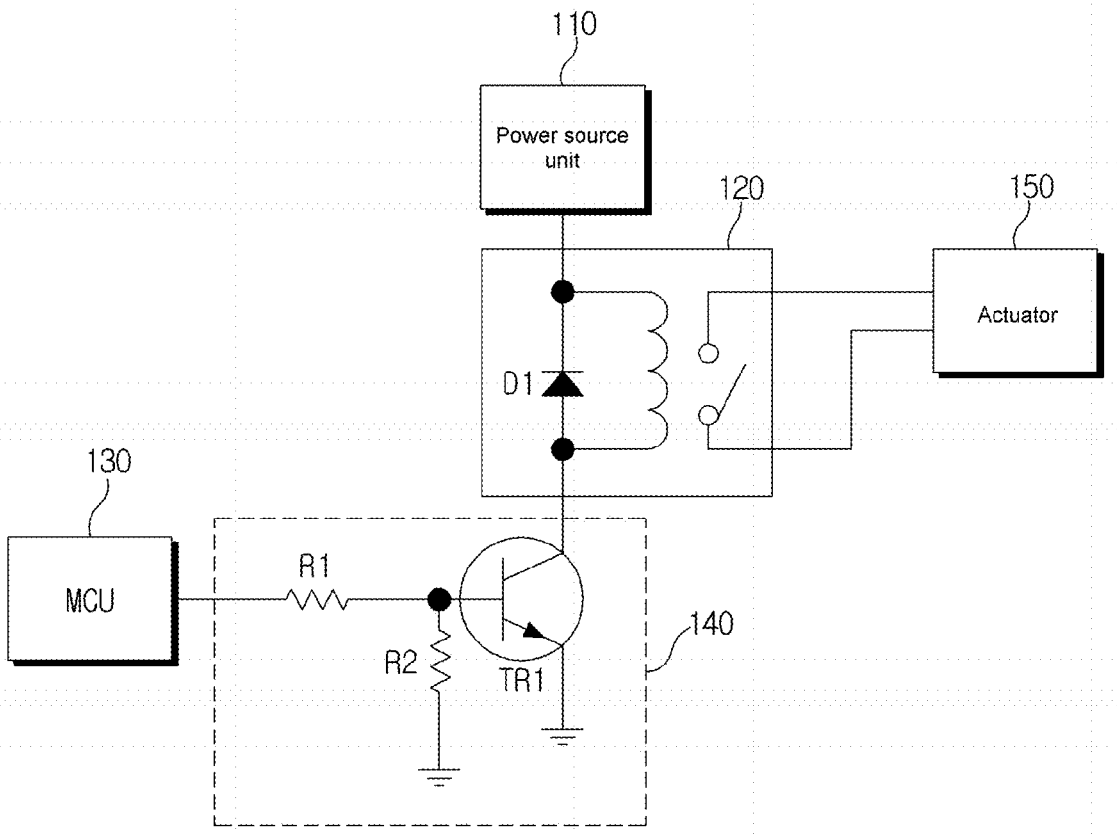
FIG. 2 is a diagram illustrating the configuration of a circuit using the switching element of a relay driver in accordance with an embodiment of the present invention.

As illustrated in FIG. 2, the relay driver 140 may include, for example, an NPN type transistor TR1 as a switching element. FIG. 2 is a diagram illustrating the configuration of a circuit using the switching element of the relay driver 140 in accordance with an embodiment of the present invention. That is, as illustrated in FIG. 2, the relay driver 140 is configured so that the MCU 130 is connected to the base of the first transistor TR1, the emitter of the first transistor TR1 is grounded, and the relay 120 is connected to the collector of the first transistor TR1. The NPN type first transistor TR1 is turned on/off in response to a relay driving signal output by the MCU 130.

Accordingly, the relay driver 140 may repeat an operation of turning on the switching element TR1 in response to the current application signal of a high level from the MCU 130 so that an electric current is supplied from the power source unit 110 to the relay 120 and an operation of turning off the switching element TR1 in response to the current non-application signal of a low level from the MCU 130 so that an electric current from the power source unit 110 is not applied to the relay 120. In FIG. 2, first and second resistors R1 and R2 connected in parallel to the output terminal of the MCU 130 and the base of the first transistor TR1 are resistors for voltage distribution. A first diode D1 connected to the collector of the first transistor TR1 and to the coil terminal of the relay 120 is a diode for preventing a reverse current.

That is, when the current application signal of a high level is output through the digital output terminal of the MCU 130, the current application signal of a high level is input to the base of the first transistor TR1 of the relay driver 140 through the first and the second resistors R1 and R2.

The first transistor TR1 is turned on in response to the current application signal of a high level from the MCU 130, and thus voltage $V_B$ is applied to the coil terminal of the relay 120. As a result, the coil of the relay 120 is excited, the contact point terminal of the relay 120 is closed, and thus the relay 120 is driven.

In contrast, when the current non-application signal of a low level is output through the digital output terminal of the MCU 130, the current non-application signal of a low level is input to the base of the first transistor TR1 through the first and the second resistors R1 and R2. The first transistor TR1 is turned off in response to the current non-application signal of a low level from the MCU 130, and thus the relay 120 is not driven in response to the turn-off operation of the first transistor TR1.

Figure 3:
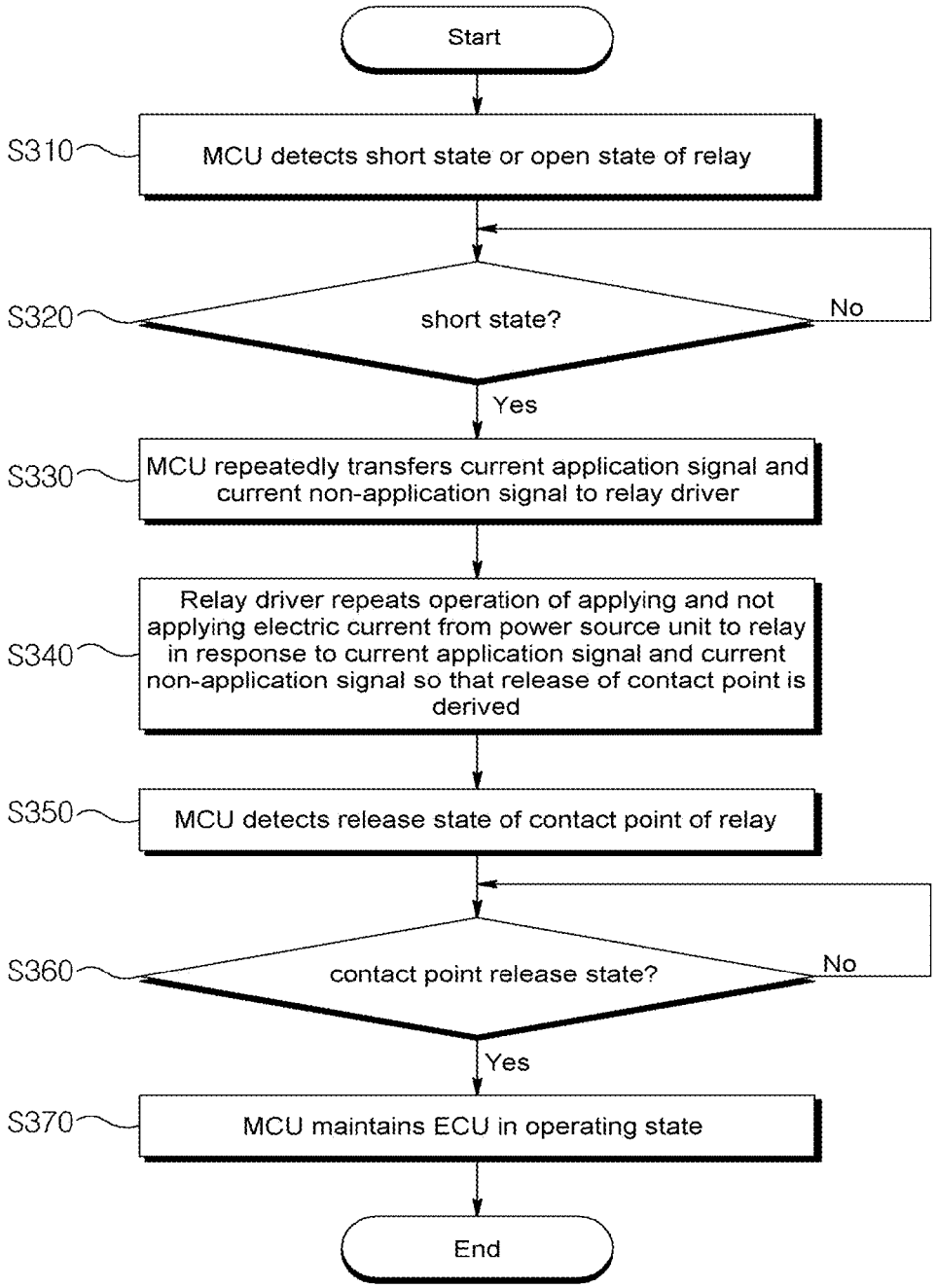
FIG. 3 is a flowchart illustrating a method of restoring, by the apparatus, a mechanical relay from a stuck fault to a normal condition in accordance with an embodiment of the present invention.

FIG. 3 is a flowchart illustrating a method of restoring, by the apparatus, the mechanical relay from a stuck fault to a normal condition in accordance with an embodiment of the present invention.

Referring to FIG. 3, first, the MCU 130 of the apparatus 100 for restoring the mechanical relay from a stuck fault to a normal condition in accordance with an embodiment of the present invention detects the short state or open state of the relay 120 at step S310.

Figure 4:
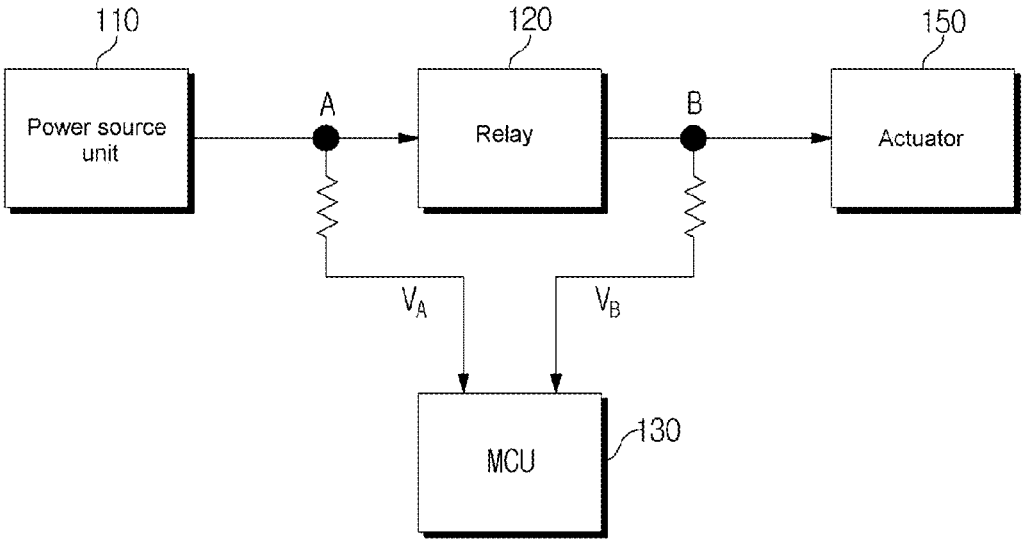
FIG. 4 is a diagram illustrating an example in which a relay detects a short state or an open state in accordance with an embodiment of the present invention.

In this case, the MCU 130 may detect the short state or the open state based on a voltage difference obtained by comparing voltage $V_A$ at the front of the relay 120 with voltage $V_B$ at the rear of the relay 120 when a power source from the power source unit 110 is supplied to the actuator 150 through the relay 120 as illustrated in FIG. 4. FIG. 4 is a diagram illustrating an example in which the relay 120 detects the short state or the open state in accordance with an embodiment of the present invention.

Figure 5:
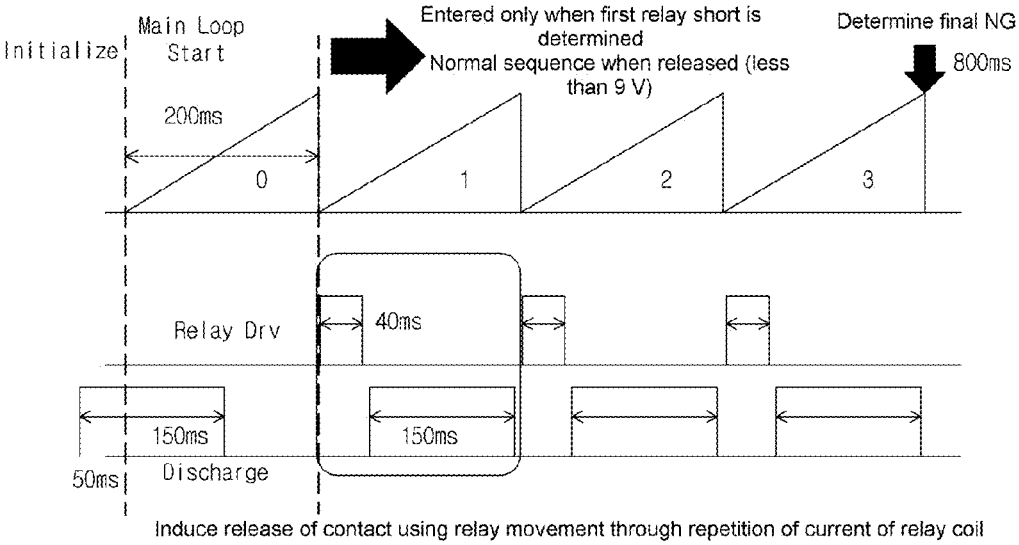
FIG. 5 is a diagram illustrating an example of a driving signal that repeats an operation for periodically applying an electric current to the relay in accordance with an embodiment of the present invention.

Thereafter, when the relay 120 is in the short state at step S320, the MCU 130 repeatedly transfers a current application signal and a current non-application signal, such as those illustrated in FIG. 5, to the relay driver 140 at step S330. FIG. 5 is a diagram illustrating an example of a driving signal that repeats an operation for periodically applying an electric current to the relay 120 in accordance with an embodiment of the present invention. As illustrated in FIG. 5, the MCU 130 applies the current application signal of a high level to the relay driver 140 during 40 ms and the current non-application signal to the relay driver 140 during 150 ms in a cycle of 200 ms in which the driving signal is applied to the relay driver 140. Accordingly, the electric current is repeatedly supplied to the coil of the relay 120 by the on/off driving operations for the relay 120 of the relay driver 140, and thus the release of the contact point of the relay 120 that has been stuck is derived.

Thereafter, the relay driver 140 repeats the operation of periodically applying the electric current from the power source unit 110 to the relay 120 in response to the current application signal and the current non-application signal so that the release of the contact point is derived at step S340.

That is, the relay driver 140 repeats the operation of turning on the switching element TR1 in response to the current application signal of a high level so that the electric current is supplied from the power source unit 110 to the relay 120 or the operation of turning off the switching element TR1 in response to the current non-application signal of a low level so that an electric current is not applied from the power source unit 110 to the relay 120.

Thereafter, the MCU 130 detects the release state of the contact point of the relay 120 at step S350. When the contact point of the relay 120 is released (Yes at step S360), the MCU 130 maintains the ECU 160 in the operating state at step S370.

Accordingly, when a stuck fault is generated in the relay 120, the operation of periodically applying an electric current to the coil of the relay is repeated so that heat and an electrical movement are supplied. Accordingly, a temporary stuck problem can be solved, and the ECU can be prevented from being determined to be a failure due to the temporary stuck state.

As described above, the embodiments of the present invention can achieve the method and apparatus for restoring a mechanical relay from a stuck fault to a normal condition, wherein if a temporary stuck fault attributable to impurities at the contact point of the mechanical relay or a low temperature is generated in the mechanical relay when the ECU detects a failure that may affect a driver, the operation of periodically applying an electric current to the coil of the mechanical relay configured to stop a random operation of the actuator by blocking the supply of an electric current to the actuator is repeated so that heat and an electrical movement are provided, thereby being capable of restoring the mechanical relay from the temporary stuck fault to a normal condition and preventing the ECU from being detected as being a failure.

In accordance with the present invention, when a stuck fault is generated in the mechanical relay, the operation of periodically applying an electric current to the coil of the mechanical relay is repeated so that heat and an electrical movement are supplied. Accordingly, a temporary stuck problem can be solved, and the ECU can be prevented from being determined to be a failure due to a temporary stuck state.

The present invention may be applied to a method and apparatus for restoring a mechanical relay from a stuck fault to a normal condition, which are capable of restoring the mechanical relay from a temporary stuck fault to a normal condition and preventing an ECU from being detected as being a failure by repeating the operation of periodically applying an electric current to the coil of the relay so that heat and an electrical movement are supplied when the temporary stuck fault attributable to impurities at the contact point of the mechanical relay or a low temperature is generated in the mechanical relay.

As described above, those skilled in the art to which the present disclosure pertains will understand that the present disclosure may be implemented in various detailed forms without changing the technical spirit or indispensable characteristics of the present disclosure. It will be understood that the aforementioned embodiments are illustrative and not limitative from all aspects. The scope of the present disclosure is defined by the appended claims rather than the detailed description, and the present disclosure should be construed as covering all modifications or variations derived from the meaning and scope of the appended claims and their equivalents.

What is claimed is:

1. A method for restoring a relay from a stuck fault to a normal condition in an apparatus comprising a power source unit, the relay, a relay driver, a Main Control Unit (MCU), and an Electronic Control Unit (ECU), the method comprising steps of:

detecting, by the MCU, a short state or open state of the relay;

repeatedly transferring, by the MCU, a current application signal and a current non-application signal to the relay driver when the relay is in the short state;

repeating, by the relay driver, an operation of periodically applying an electric current from the power source unit to the relay in response to the current application signal and the current non-application signal so that a release of a contact point of the relay is induced;

detecting, by the MCU, the release state of the contact point of the relay; and maintaining, by the MCU, the ECU in an operating state when the contact point of the relay is released.

2. The method according to claim 1, wherein detecting the short state or open state of the relay comprises detecting, by the MCU, the short state or the open state based on a voltage difference obtained by comparing voltage at a front of the relay with voltage at a rear of the relay when a power source from the power source unit is supplied to an actuator through the relay.

3. The method according to claim 1, wherein repeating the operation of periodically applying the electric current comprises repeating, by the relay driver, an operation of turning on a switching element in response to the current application signal of a high level so that the electric current is applied from the power source unit to the relay or an operation of turning off the switching element in response to the current non-application signal of a low level so that an electric current is not applied from the power source unit to the relay.

4. An apparatus for restoring a mechanical relay from a stuck fault to a normal condition, comprising:

a power source unit configured to supply a power source;

a relay configured to supply the power source from the power source unit to an actuator or block the supply of the power source from the power source unit to the actuator;

a relay driver configured to execute the supply or blocking of the relay according to a switching operation; and a Main Control Unit (MCU) configured to detect a short state or open state of the relay and to repeatedly transfer a current application signal and a current non-application signal to the relay driver when the relay is in the short state, wherein the relay driver repeats an operation of periodically applying an electric current from the power source unit to the relay in response to the current application signal and the current non-application signal so that a release of a contact point of the relay is induced, and the MCU detects the release state of the contact point of the relay and maintains an Electronic Control Unit (ECU) in an operating state when the contact point of the relay is released.

5. The apparatus according to claim 4, wherein the MCU is further configured to detect the short state or open state of the relay based on a voltage difference obtained by comparing voltage at a front of the relay and voltage at a rear of the relay when a power source from the power source unit is supplied to the actuator through the relay.

6. The apparatus according to claim 4, wherein the relay driver is further configured to repeat an operation of turning on a switching element in response to the current application signal of a high level so that the electric current is applied from the power source unit to the relay or an operation of turning off the switching element in response to the current non-application signal of a low level so that an electric current is not applied from the power source unit to the relay.

* * * * *